US007066437B2

(12) United States Patent
Iizuka

(10) Patent No.: US 7,066,437 B2
(45) Date of Patent: Jun. 27, 2006

(54) PORTABLE BOOKSTAND

(76) Inventor: Takashi Iizuka, 19-12, Minamidai 4-chome, Nakanoku, Tokyo 164-0014 (JP)

( * ) Notice: Subject to any disclaimer, the term of this patent is extended or adjusted under 35 U.S.C. 154(b) by 0 days.

(21) Appl. No.: 10/506,770

(22) PCT Filed: Mar. 4, 2003

(86) PCT No.: PCT/JP03/02468

§ 371 (c)(1),
(2), (4) Date: Sep. 3, 2004

(87) PCT Pub. No.: WO03/073888

PCT Pub. Date: Sep. 12, 2003

(65) Prior Publication Data

US 2005/0167561 A1 Aug. 4, 2005

(30) Foreign Application Priority Data

Mar. 7, 2002 (JP) ..... 2002-109813
May 16, 2002 (JP) ..... 2002-179191
Jul. 19, 2002 (JP) ..... 2002-242715

(51) Int. Cl.
*A47B 97/04* (2006.01)

(52) U.S. Cl. ..... 248/447; 248/458

(58) Field of Classification Search ..... 248/447, 248/448, 451, 458, 460, 444.1, 444, 346.03, 248/346.06, 346.07
See application file for complete search history.

(56) References Cited

U.S. PATENT DOCUMENTS 1,071,428 A * 8/1913 Jones ..... 248/448
1,184,246 A * 5/1916 Klein ..... 248/448
3,076,285 A 2/1963 Sparkman ..... 45/85
3,140,558 A 7/1964 Cassidy ..... 45/85
3,813,075 A * 5/1974 Capper ..... 248/461
4,181,282 A * 1/1980 Oliver et al. ..... 248/448
5,362,023 A 11/1994 Reyes ..... 248/461
5,580,024 A 12/1996 Briee ..... 248/444.1
5,720,465 A * 2/1998 Peltzer et al. ..... 248/453

FOREIGN PATENT DOCUMENTS

DE 39 03 543 A1 3/1990

OTHER PUBLICATIONS

European Office Action, Dated May 31, 2005.

* cited by examiner

*Primary Examiner*—A. Joseph Wujciak

(74) *Attorney, Agent, or Firm*—McGinn IP Law Group, PLLC

(57) ABSTRACT

The base of a conventional bookstand on which to support a book is a rectangular base having an area substantially as large as an opened book whereas the invention employs a method of placing a book on a crisscross form defined by a horizontal base and a vertical base crossing each other. The horizontal and vertical bases are in the form of elongated rectangles of substantially the same size, and the vertical base placed on the horizontal base is supported for slide turning movement around a support shaft of the horizontal base. On the right and left sides of the horizontal base, the right and left side pages of a book are held down by transparent page binders having guide rods slidable in guide grooves formed inside the horizontal base. An opening/closing stand is provided on the back surface of the horizontal base. The bookstand of the invention has the four parts laminatable in the plane of the horizontal base so as to reduce the size.

6 Claims, 2 Drawing Sheets

PORTABLE BOOKSTAND

TECHNICAL FIELD

The present invention relates to a foldable, portable bookstand.

BACKGROUND ART

Conventional bookstands, even if they are called "portable", have a large book mounting plate. Thus, no conventional bookstands are compact enough to carry by hand.

In view of this, the present invention provides a foldable bookstand having a novel mechanism. This mechanism makes the book mounting plate and page mounting clips more compact than any conventional bookstand so that the bookstand is easily carried by hand.

DISCLOSURE OF THE INVENTION

The book mounting plate of the conventional bookstand is a rectangular plate of a size substantially as large as an opened book. The bookstand of the present invention has a horizontal member and a rotatable member crossing each other to support a book. The rotatable member and horizontal member have substantially the same size, having an elongated rectangular shape. The rotatable member superposed on the horizontal member can rotate about a support shaft provided at the center of the horizontal member. The rotatable member can also slide relative to the horizontal member, and the sliding movement is limited by the support shaft.

The horizontal member has transparent binders at right and left ends thereof to clamp right and left pages of a book. Each binder has guide rods that slide long grooves formed in the horizontal member. Right and left pedestals are provided at a back face of the horizontal member such that the pedestals can pivot and extend from a retracted position.

The above described four parts of the bookstand of the present invention can be folded within an area of the horizontal member. Thus, the bookstand can become very compact.

BEST MODE FOR CARRYING OUT THE INVENTION

Figure 1:
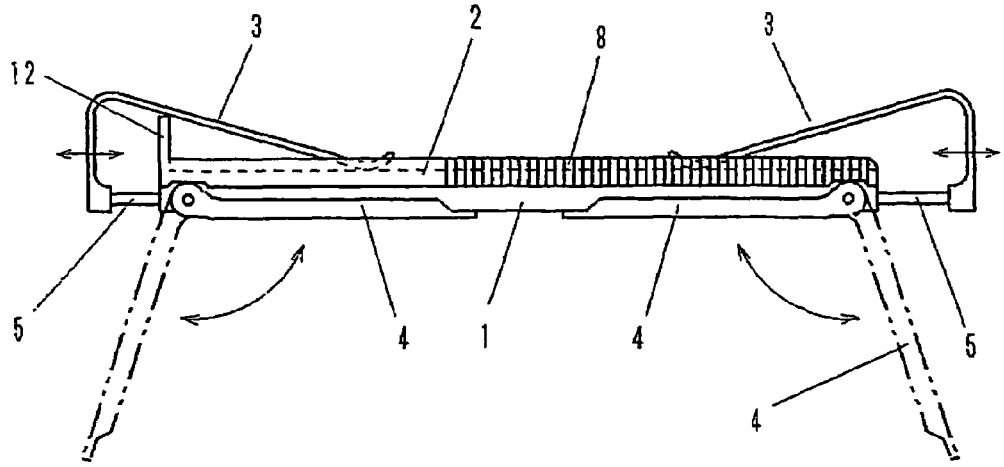
FIG. 1 is a front view of a bookstand.

FIG. 1 is a front view of a portable bookstand of the present invention in a folded condition. In FIG. 1, four parts of the bookstand (i.e., a horizontal member 1, a rotatable member 2, transparent binders 3 and pedestals 4) are sequentially stacked.

Two parallel guide rods 5 are fixed to each transparent binder 3, and slide along grooves formed in the horizontal member. Thus, the transparent binders can move to right and left positions (i.e., to an open position and a closed position).

A shaft 6 is provided at the center of the horizontal member 1. The rotatable member 2 has a groove 7 which extends in the upper half of the rotatable member. The groove of the rotatable member 2 slidably engages with the shaft 6 of the horizontal member 1. In order to prevent disengagement between the rotatable member and the horizontal member, the head of the shaft 6 is greater than the groove of the rotatable member 2.

Figure 2:
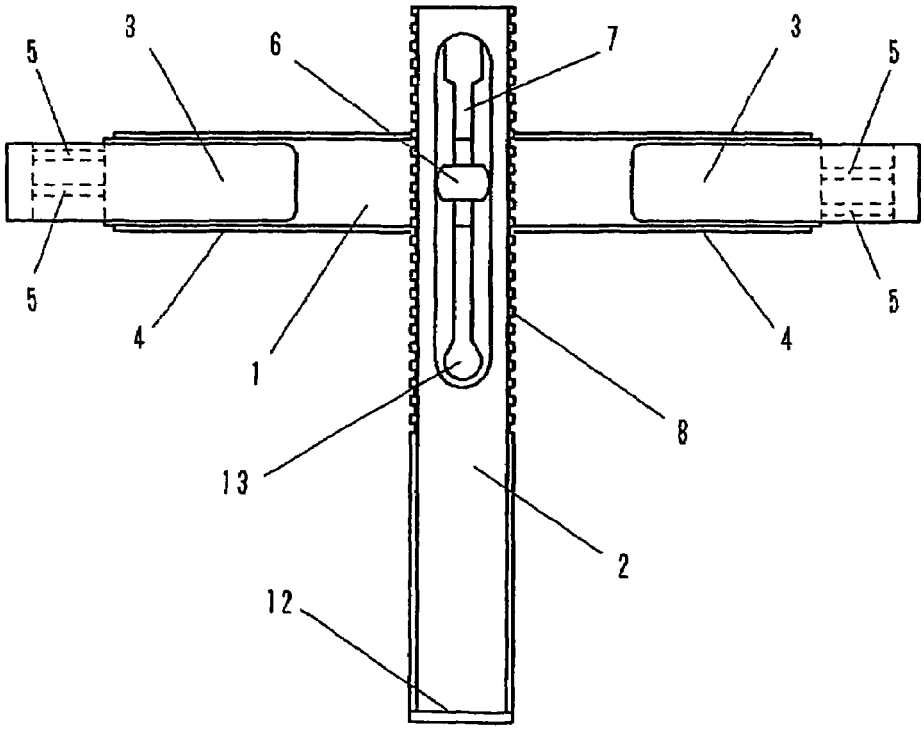
FIG. 2 illustrates a plan view of the bookstand when horizontal and rotatable members extend perpendicularly.

The groove 7 of the rotatable member 2 has an end hole 13 larger than the width of the groove 7 so that the rotatable member 2 can rotate when the center of the rotatable member 2 matches the center of the horizontal member 1. When the rotatable member 2 rotates 90 degrees, the groove 7 can slide, with the shaft 6 being engaged with the groove 7. (FIG. 2)

Figure 3:
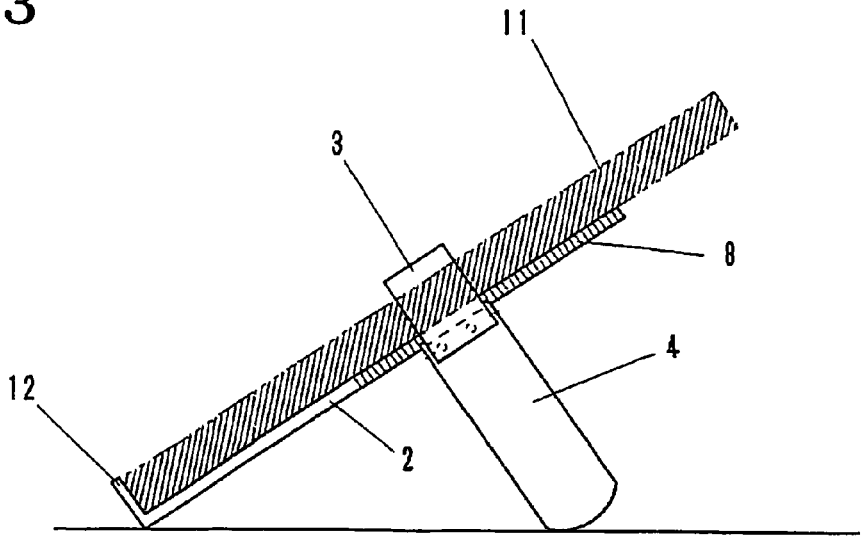
FIG. 3 illustrates a lateral view of the bookstand when placed on a desk.

When the bookstand of the present invention has to support a book, the transparent binders 3 are pulled to the right and left and the rotatable member is rotated 90 degrees so that the rotatable member extends perpendicularly to the horizontal member. A book 11 can be placed on the criss-cross structure of the rotatable member and horizontal member, and right and left pages of the book are pressed down by the transparent binders. The pedestals 4 are extended to the right and left "open" positions from the ends of the horizontal member, and the bookstand is put on the desk. The lower end of the rotatable member and the right and left pedestals are in contact with the desk so that the bookstand can stand diagonally. (FIG. 3).

The rotatable member 2 has a stopper 12 to support the lower end of the book at the lower end thereof.

Figure 4:
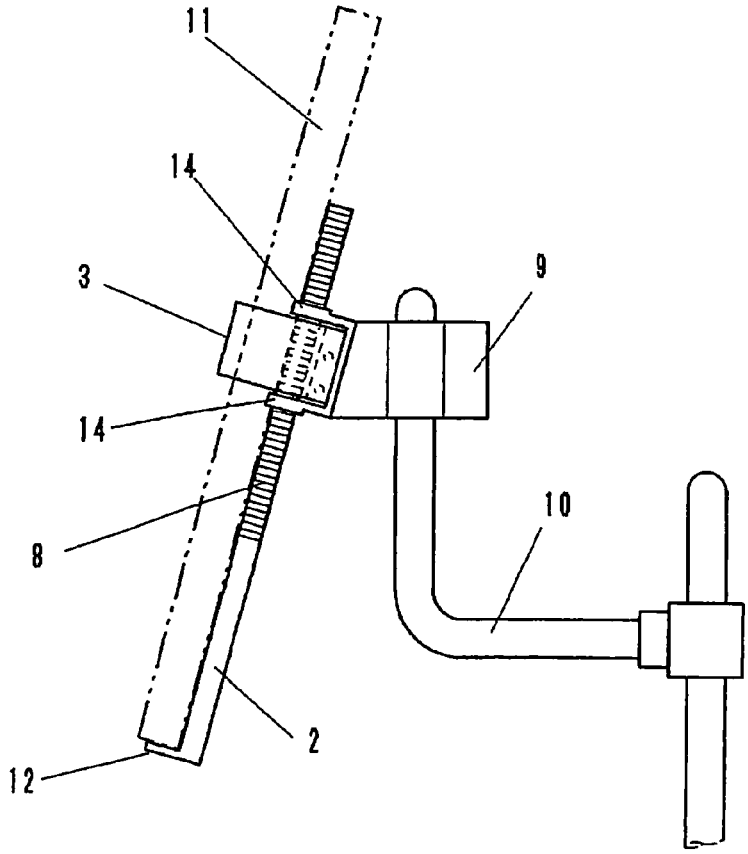
FIG. 4 illustrates the bookstand attached to a holder.

The rotatable member has continuous teeth 8 on its lateral faces. The teeth 8 engage with claws 14 of the holder 9 so that the holder can support the crossing portion of the horizontal member and the rotatable member. Since the holder 9 fixes the rotatable member and horizontal member, as shown in FIG. 4, the bookstand of the present invention can be attached to an arm 10.

By attaching the bookstand to the arm 10, the book is supported in the air without occupying any area on the desk. The bookstand of the present invention can be used by a person in bed.

INDUSTRIAL APPLICABILITY

The bookstand becomes greatly compact and easy to carry. This significantly improves usefulness of the bookstand.

By using the bookstand, a person does not have to use hands to hold a book. The person therefore can use hands to only operate, for example, a computer. The person can concentrate on reading. The person can read a book in a desired posture. This prevents eye fatigue, headache, shoulderache, etc.

The invention claimed is:

1. A portable bookstand comprising:

a horizontal member having an elongated rectangular shape, the horizontal member being elongated in right and left directions:

a shaft provided at a center of the horizontal member:

a hollow portion formed in the horizontal member:

a guide member provided in the hollow portion of the horizontal member:

a rotatable member having an elongated rectangular shape which is substantially the same size as the horizontal member, the rotatable member being supported on the horizontal member such that the rotatable member is able to rotate and slide about the shaft provided at the center of the horizontal member:

right and left guide rods received in the hollow portion of the horizontal member and engaged with the guide member such that the right and left guide rods are movable in the right and left directions of the horizontal member along the guide member, respectively, to reach an extended position and retract to a retracted position respectively:

right and left transparent binders fixed to the right and left guide rods, respectively, for pressing down right and left pages of a book: and at least one pedestal provided on a back face of the horizontal member such that the at least one pedestal is movable between an extended position and a retracted position.

2. The portable bookstand according to claim 1, wherein the rotatable member includes continuous teeth on its lateral faces.

3. The portable bookstand according to claim 1, wherein the rotatable member includes a groove which engages with the shaft of the horizontal member to define a range of movement of the rotatable member with respect to the horizontal member.

4. The portable bookstand according to claim 3, wherein a head of the shaft of the horizontal member is greater than the groove of the rotatable member.

5. The portable bookstand according to claim 1, wherein the at least one pedestal comprises right and left pedestals.

6. The portable bookstand according to claim 1, wherein the rotatable member includes a projecting element at one end thereof to support a lower edge of the book.

* * * * *